US010442605B2

(12) United States Patent
Brunt et al.

(10) Patent No.: US 10,442,605 B2
(45) Date of Patent: Oct. 15, 2019

(54) SPRAYING DEVICE

(71) Applicant: Reckitt Benckiser (Brands) Limited, Slough, Berkshire (GB)

(72) Inventors: James Edward Brunt, Salt Lake City, UT (US); Martin Butler, Kwun Tong (HK); Avijit Das, Hull (GB); Richard Gamble, Slough (GB); David Sanders, Warwick (GB); Christopher Witty, Hull (GB); Simon Woolley, Hull (GB)

(73) Assignee: Reckitt Benckiser (Brands) Limited, Slough, Berkshire (GB)

( * ) Notice: Subject to any disclaimer, the term of this patent is extended or adjusted under 35 U.S.C. 154(b) by 0 days.

(21) Appl. No.: 15/752,511

(22) PCT Filed: Sep. 19, 2016

(86) PCT No.: PCT/GB2016/052915
§ 371 (c)(1),
(2) Date: Feb. 13, 2018

(87) PCT Pub. No.: WO2017/046615
PCT Pub. Date: Mar. 23, 2017

(65) Prior Publication Data

US 2018/0237212 A1 Aug. 23, 2018

(30) Foreign Application Priority Data

Sep. 18, 2015 (GB) ..... 1516546.7

(51) Int. Cl.
*B65D 83/38* (2006.01)
*B65D 83/26* (2006.01)
*B05B 11/00* (2006.01)

(52) U.S. Cl.
CPC ..... *B65D 83/384* (2013.01); *B05B 11/0037* (2013.01); *B05B 11/0038* (2018.08); *B65D 83/262* (2013.01); *B05B 11/0091* (2013.01)

(58) Field of Classification Search
CPC .. B65D 83/384; B65D 83/262; B05B 11/0037
(Continued)

(56) References Cited

U.S. PATENT DOCUMENTS 2,966,283 A * 12/1960 Darvie ..... B65D 83/386 222/162
3,347,423 A * 10/1967 Babbin ..... B65D 83/206 222/153.06

(Continued)

FOREIGN PATENT DOCUMENTS

EP 2095883 A1 9/2009
FR 2871712 A1 12/2005

(Continued)

OTHER PUBLICATIONS

International Search Report and Written Opinion of the International Searching Authority for corresponding application PCT/GB2016/052915 dated Dec. 21, 2016.

(Continued)

*Primary Examiner* — Vishal Pancholi
(74) *Attorney, Agent, or Firm* — Norris McLaughlin PA

(57) ABSTRACT

A spraying device for spraying fluid from a replaceable refill is described wherein the refill possesses a refill body containing a reservoir of fluid to be sprayed, a valve stem in fluid communication with the reservoir and a spray head mounted on the valve stem, the spray head having an exit nozzle, wherein the spray device comprises:
a housing formed from an top portion and a base portion which are releasably connectable with each other through
(Continued)

contact between engagement means on each portion, wherein the top portion comprises:
a cavity configured to house at least an top portion of the refill therein;
a top surface and an engagement surface having an top portion housing wall therebetween, wherein the top portion housing wall has a thickness;
an actuation mechanism configured, in use, to actuate the spray head to spray fluid via the exit nozzle;
a spray opening configured to permit, in use, sprayed fluid to exit the device into the surrounding environment;
and wherein the base portion comprises:
a cavity configured to house at least a base portion of the refill therein said cavity being defined by a cavity wall and a support platform configured, in use, to support the refill at a predefined position in the cavity;
the base portion being provided with an engagement surface and a bottom surface and a base portion housing wall therebetween;
wherein the base portion housing wall at least adjacent the bottom surface is spaced apart from the cavity wall by at least the predefined top housing wall thickness to define a top portion receiving channel; and whereby the device facilitates an operational configuration wherein the top portion and the base portion of the housing are engaged with each other by their respective engagement means with the refill located within the respective cavities; and wherein the device facilitates a packaged configuration wherein at least the engagement means and at least a some of the top portion housing wall of the top portion are located within the top portion receiving channel.

7 Claims, 3 Drawing Sheets

(58) Field of Classification Search
USPC ..... 222/182, 325, 401, 402, 402.13, 402.14
See application file for complete search history.

(56) References Cited

U.S. PATENT DOCUMENTS

| | | | | | |
|---|---|---|---|---|---|
| 3,534,890 | A * | 10/1970 | Iannacone | A61M 15/009 | 222/325 |
| 5,358,147 | A * | 10/1994 | Adams | B65D 83/386 | 222/183 |
| 5,875,934 | A * | 3/1999 | Miller | B65D 83/206 | 222/183 |
| 6,569,387 | B1 * | 5/2003 | Furner | A01M 1/2033 | 222/183 |
| 8,079,498 | B2 * | 12/2011 | Anderson | A61L 9/14 | 222/183 |
| 8,328,122 | B2 * | 12/2012 | Bedford | B65D 83/384 | 222/635 |
| 8,459,508 | B2 * | 6/2013 | Westphal | B65D 83/386 | 222/131 |
| 8,573,447 | B2 * | 11/2013 | Muderlak | B65D 83/262 | 222/153.03 |
| 2007/0181609 | A1 * | 8/2007 | Rymer | B65D 83/205 | 222/402.1 |

FOREIGN PATENT DOCUMENTS

| | | | |
|---|---|---|---|
| JP | 2013244432 | A | 12/2013 |
| WO | 9608425 | A2 | 3/1996 |
| WO | 2014134665 | A1 | 9/2014 |

OTHER PUBLICATIONS

GB Search Report for corresponding application GB1516546.7 dated Feb. 17, 2016.

* cited by examiner

SPRAYING DEVICE

This is an application filed under 35 USC 371 based on PCT/GB2016/052915, filed 19 Sep. 2016, which in turn is based on GB 1516546.7 filed 18 Sep. 2015. The present application claims the full priority benefit of these prior applications and herein incorporates by reference the full disclosures of these prior applications.

FIELD OF THE INVENTION

The present invention relates to improvements in devices for spraying a fluid and particularly, but not exclusively to devices for spraying fluids such as fragrances, deodorizing fluids and/or a pest control material or the like.

BACKGROUND

Prior art devices for spraying fragrances, deodorising agents and sanitising fluids into a room generally consist of a device containing a removable source of fluid. With such an arrangement once the source of fluid has been completely exhausted, the source can be replaced rather than replacing the entire device. Typically such sources come in many forms including containers, bottles, canisters and cartridges (generically, all such containers, bottles, cans and cartridges hereinafter will be referred to as "refills"). Such refills can be pump sprays or aerosols, including metered and non-metered versions thereof.

Known prior art devices are typically provided with a recess to permit wall mounting and with a flat base to permit the device to be free standing on a flat surface. These devices typically comprise a two-part housing of a main body and a cover, the main body holds an actuation mechanism typically consisting of an electrically powered motor, gears, actuation arm, batteries and the like. The main body is further provided with a refill receiving means which typically is formed of a support plate at or adjacent the base to support the base of a refill. The main body is further provided with a support channel adjacent the actuation mechanism, the support channel being present to laterally support a spray head of the refill during actuation, ie—during depression of the spray head by the actuation arm of the actuation mechanism during operation to spray a quantity of fluid from the refill out into the surrounding environment through the spray head. The cover is provided with a spray opening configured to be adjacent the support channel such that an exit nozzle of the spray head will face the opening to permit, in use, sprayed fluid to exit the device. The main body and cover are connected via a hinge adjacent the base of the device to form a closure via a clamshell arrangement to seal the refill inside the device. There are also examples of prior art where the hinge is provided along the side of the main body to produce the clamshell arrangement.

Despite the prior art devices being commonplace anecdotal data suggests that upwards of 25% of refills are purchased without the purchaser knowing that such refills are intended for use in an automatic spraying device and/or without the purchaser knowing which automatic spraying device the purchased refill is intended to be used with.

It is an object of the present invention to remove, reduce or ameliorate the above-mentioned drawbacks as well as address other concerns with the prior art devices.

SUMMARY OF INVENTION

According to a first aspect of the present invention there is provided therefor a spraying device for spraying fluid from a replaceable refill comprising a refill body containing a reservoir of fluid to be sprayed, a valve stem in fluid communication with the reservoir and a spray head mounted on the valve stem, the spray head having an exit nozzle, wherein the spray device comprises:

a housing formed from an top portion and a base portion which are releasably connectable with each other through contact between engagement means on each portion, wherein the top portion comprises:

a cavity configured to house at least an top portion of the refill therein;

a top surface and an engagement surface having an top portion housing wall therebetween, wherein the top portion housing wall has a thickness;

an actuation mechanism configured, in use, to actuate the spray head to spray fluid via the exit nozzle;

a spray opening configured to permit, in use, sprayed fluid to exit the device into the surrounding environment;

and wherein the base portion comprises:

a cavity configured to house at least a base portion of the refill therein said cavity being defined by a cavity wall and a support platform configured, in use, to support the refill at a predefined position in the cavity;

the base portion being provided with an engagement surface and a bottom surface and a base portion housing wall therebetween;

wherein the base portion housing wall at least adjacent the bottom surface is spaced apart from the cavity wall by at least the predefined top housing wall thickness to define a top portion receiving channel;

and whereby the device facilitates an operational configuration wherein the top portion and the base portion of the housing are engaged with each other by their respective engagement means with the refill located within the respective cavities; and wherein the device facilitates a packaged configuration wherein at least the engagement means and at least a some of the top portion housing wall of the top portion are located within the top portion receiving channel.

A key advantage of spraying device of the first aspect of the present invention is that it is configurable to be placed in a packaged configuration by a manufacturer but can easily be reconfigured by an end user, such as a home owner in a domestic environment, into an operation configuration. The advantage of this duality of configurations for the spraying device provides a series of hitherto unforeseen and unrealised benefits which include improved recognition of device to refill interoperability. Interoperability is particularly problematic where the spraying device is substantially bigger than the refill. Since spraying devices at issue are inherently bigger than their refills due to the need to surround the refill as well as house an actuation mechanism and possibly a power source such as batteries and this almost universally ensures that when these devices are made available for sale by a retailer the device and its associated packaging is too large to be positioned on a mid-height shelf where the refills are typically located being a more frequently purchased item, thus is typically located on an uppermost shelf which is without a height restriction. This remote location of device and refill on a shelf inherently provides confusion to a prospective purchaser. One remedy to overcome this deployed in the prior art is to package the device with a refill but this is undesirable not least because it limits the purchaser to a pre-selected refill which may not be to the purchaser's preference, in particular in the field of air freshening where fragrance variety is potentially polarising for a purchaser, but also increases the expense of the packaged product, requires more packaging so less environmentally friendly, both of which increase the retail price of the product. In contrast the packaged configuration of the spraying device according to the present invention overcomes these drawbacks by permitting the device to occupy a smaller volume than when in a operation configuration thus allowing less packaging to be used, negating the need to package the device with a refill and, most importantly, permitting the device to be located on the same shelf as a refill.

Preferably the packaged configuration permits the device to possess a height that is substantially the same as the refill. Even more preferably the packaged configuration permits the device to possess a height that is the same or less than the refill.

Preferably the top portion receiving channel extends at least 20% of the height of the base portion wall, and even more preferably at least 35% of the height of the base portion wall, and most preferably at least 50% of the height of the base portion wall.

The support platform may be provided by refill retaining means in the form one or more refill straps. Said one or more refill straps are preferably formed by an L-shaped member wherein the longer part of the member is mounted or formed on an inner surface of the cavity wall of the base portion to permit flexibility and/or hinged rotation thereabout and extends downwardly to permit the shorter part of the member to project toward a central point of the base portion and are configured to contact the base of the refill. Said one or more refill straps are preferably biased such that the longer part of the member is biased out of contact with the inner surface of the base portion housing. Preferably between 2 and 6 refill straps are provided, and most preferably 4 refill straps are provided.

The engagement means may be provided as part of the engagement surface. Preferably the engagement means engages and disengages by a user applying rotational force to one or both of the top portion of the device housing and/or base portion of the device housing. Most preferably the engagement means are provided by a bayonet arrangement. A bayonet arrangement is preferred as this provides a defined engagement point at which a user can easily determine whether the two housing portions are engaged. Alternatively the engagement means may be provided by a screw thread.

Alternatively the top portion and the base portion of the device housing may be brought into engagement with each other without rotation or without substantial rotation via push-fit arrangement. Where engagement between the top portion and base portion is provided without rotation or without substantial rotation, the engagement means may be a push-fit connection or the like.

The actuation mechanism preferably comprises an electrically powered motor with one or more gears connected to the motor and an actuation arm connected to at least one of the motor or the gears. The actuation mechanism may further comprise batteries, a control unit, user-operable control input means.

The spraying device housing may be provided with any outer shape. Preferably the spraying device housing defines a generally cylindrical shape wherein the top portion is provided by a generally cylindrically-shaped housing which is open at one end to permit entry to the top portion of the refill and the bottom portion is provided by a generally cylindrically-shaped housing to permit entry to the base portion of the refill. The top portion may further comprise a lid remote from the open end and which is accessible from the exterior of the device, the lid may provide a cover to one or more of: a battery compartment, the actuation mechanism, user input controls. The base portion may comprise a generally cylindrical side wall connected to a base wall, preferably where refill straps are provided the base portion is not provided with a base wall.

The top portion may further comprise an alignment means for cooperation with the spray opening wherein alignment is provided to the refill spray head, in use, by a radially-spaced ledge substantially co-axial with the valve stem of the refill, the ledge being provided with an at least partially hollow core to receive at least a portion, in use, of the refill spray head, and wherein the ledge extends downwardly from the top portion toward the base portion such that the ledge adjacent the spray opening extends less than the rearmost part of the ledge that is remote from the spray opening which extends furthermost.

The alignment means may be advantageous in providing a device in which a user is incapable of incorrectly placing or replacing a refill therein since regardless of the orientation of the spray head on insertion, as the top portion of the device housing and the base portion of the device housing are brought into engagement with each other the alignment means will contact the spray head of the refill and rotate the spray head about its valve stem on which it is mounted such that the spray exit nozzle is facing the spray opening in the housing. Alternatively if the torque to overcome is lower, the action of bringing the top portion of the device housing and the base portion of the device housing into engagement with each other may permit the alignment means to contact the spray head of the refill and may cause the rotation of the valve stem to which the spray head is mounted such that the spray exit nozzle is facing the spray opening in the housing.

The spray head of the refill is preferably provided with a generally L-shaped profile, wherein the shorter part of the L-shape engages with the free end of the valve stem and the spray exit nozzle is located at the end of the longer part of the L-shape. An upper surface of at least the longer part of the L-shape may have a curved profile. Preferably the spray head of the refill for use with the device of the present invention is generally L-shaped with an angle of substantially 90° between the part of the spray head connected to the valve stem and the part of the spray head possessing the exit orifice; this angle may be between 60-120° however.

Preferably the radial-spacing of the ledge is of a substantially consistent radius. The ledge preferably has a substantially completely hollow core, this may ensure that various shapes of spray head may be easily accommodated within the alignment means. The ledge preferably extends downwardly from the part(s) of the ledge adjacent the spray opening to the rearmost part thereof. The ledge preferably extends downwardly at a substantially constant gradient from the part(s) of the ledge adjacent the spray opening to the rearmost part thereof. Even more preferably the ledge extends downwardly at a substantially constant gradient from the part(s) of the ledge adjacent the spray opening to a part adjacent the rearmost part whereupon it extends downwardly at a steeper gradient to the rearmost part. The rearmost part of the ledge preferably terminates in a point, this may be advantageous in that in the event of the rearmost part of the ledge contacting the spray head the point thereof will more conveniently permit the rotation thereof. The substantially consistent radius may be advantageous as the ledge can contact a localised impingement point of the spray head of a refill. The impingement point may be suitably shaped to best interact with the ledge, for instance it may be preferable for the impingement point on the refill spray head to possess a curved profile to reduce friction as the spray head is rotated by contact with the ledge. The constant gradient may be advantageous as it may facilitate a smoother rotation of the spray head about its valve stem as the spray head is rotated through contact at the impingement point by the alignment means.

Refills are typically provided with a radial valve crimp at or adjacent their uppermost surface, preferably the ledge is provided with an outer diameter that is less than the inner diameter of the radial valve crimp. The part of the ledge adjacent the spray opening may be provided with a recess or non-extension (ie-does not extend downwardly) to capture the spray head when located therein. Most preferably the part of the ledge adjacent the opening is partially or substantially or completely absent to provide a support channel to receive the spray head when located therein. The support channel may be advantageous as it reduces or removes any impingement between the ledge and the spray head at the end of any rotation which may assist in preventing any accidental actuation of the refill valve during the act of replacement. The support channel may also permit greater flexibility of refill height tolerance which in turn may also permit greater flexibility in selecting an engagement mechanism between the base and top portion of the housing. Furthermore the support channel may also permit a wider selection of actuation mechanisms since the spray head may be laterally supported during actuation by the actuation means against any movement imparted to the spray head thereby which is not co-axial with the valve stem of the spray head.

Preferably the ledge of the alignment member is provided by a ridge, preferably the ridge has a width of <1.0 cm, and more preferably a width of <0.6 cm, and most preferably a width of <0.3 cm. The narrower the ridge the smaller the impingement point on the spray head which may be advantageous when designing a suitable surface on the spray head which may function as the impingement point.

The ledge or ridge may be coated with a low-friction material to improve the ability of the alignment member to rotate the refill spray head when contacting same at the impingement point. Alternatively or additionally the ledge or ridge may be made from a low friction material, such a low friction polymers and/or self-lubricating polymers.

The device of any of the above-mentioned aspects may be provided with an indicator wherein said indicator is operable to indicate information to a user. The indicator may be operable to provide a visual indication and/or provide an audible indication. Preferably the indicator is configured to provide a visual indication by emitting light from one or more light sources, preferably one or more LEDs. The one or more light sources may be adapted to emit a different colour of light to indicate the current function the device is performing. Additionally or alternatively, the one or more light sources may blink or flash to indicate the current function the device is performing.

The device may be provided with a boost mechanism. The boost mechanism may be linked to a user operated switch or button or the like. On operating the boost mechanism the actuation means may activate to cause the immediate actuation of a refill.

The device may be power by mains-supplied electricity and/or be battery powered and/or be powered by solar cells located on the device. Most preferably the device is battery powered.

BRIEF DESCRIPTION OF THE DRAWINGS

Embodiments of the invention will now be described, by way of example only, with reference to the following drawings in which.

DESCRIPTION OF AN EMBODIMENT

Figure 1:
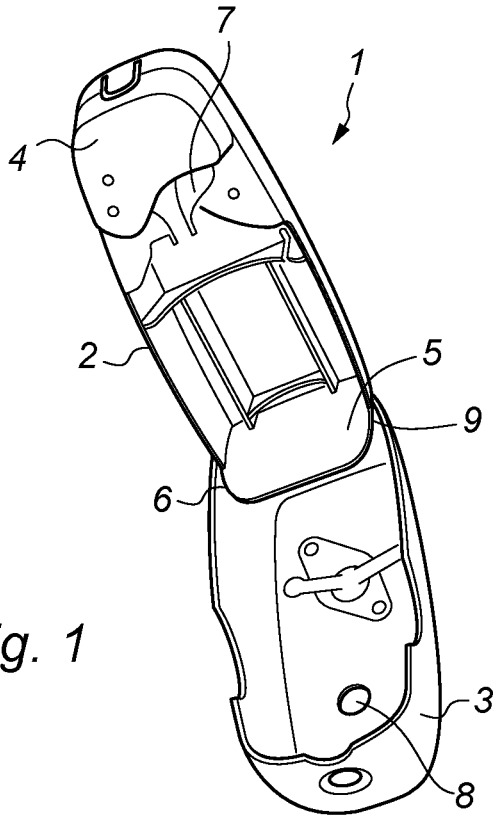
FIG. 1 illustrates a prior art device.

A prior art spraying device 1 is shown in FIG. 1 and comprises a two-part housing of a main body 2 and a cover 3 connected via a hinge 9 adjacent a base 6 of the main body 2 to form a closure via a clamshell arrangement to seal, in use, a refill inside the device 1. As can be seen, the main body 2 holds an actuation mechanism (not shown) under an inner housing 4, the actuation mechanism consists of an electrically powered motor, gears, actuation arm and batteries to power same. The main body 2 is provided with a support plate 5 adjacent its base 6 to support the base of a refill (not shown). The inner housing 4 is provided with a support channel 7 adjacent the actuation mechanism, the support channel 7 being present to laterally support a spray head of the refill during actuation, ie—during depression of the spray head by the actuation arm of the actuation mechanism during operation to spray a quantity of fluid from the refill out into the surrounding environment through the spray head. The cover 3 is provided with a spray opening 8 configured to be adjacent the support channel 7 when in a closed clamshell arrangement such that an exit nozzle of the spray head will face the opening to permit, in use, sprayed fluid to exit the device.

Without careful location of the refill into the prior art device 1, the user can inadvertently damage the refill. Some of the common incidents of damage include a user inserting the refill forcefully such that the spray head is not located within the support channel 7 and impinges against the inner housing 4 to cause the valve stem to snap. Additionally users have commonly inserted the refill into the device such that the exit nozzle on the spray head is facing the interior of the device rather than where the spray opening 8 will be when the cover 3 is closed against the and main body 2, this is problematic as the closing of the cover 3 pushes a body of the refill into the device 1 and since the spray head bears against an interior surface of the support channel 7 the closing cover causes the valve stem to bend and then snap. A further common problem is a user failing to note when the actuation arm (not shown) is fully or partially blocking the support channel 7, such as when the previous refill has been consumed and there is insufficient pressure within the refill to push the actuation arm back to its starting position, the user can then cause the valve stem to snap when attempting to force the spray head into the support channel 7 or by closing the cover 3 which pushes the body of the refill into the device 1 and causes the valve stem to bend against the actuation arm before snapping.

Figure 2:
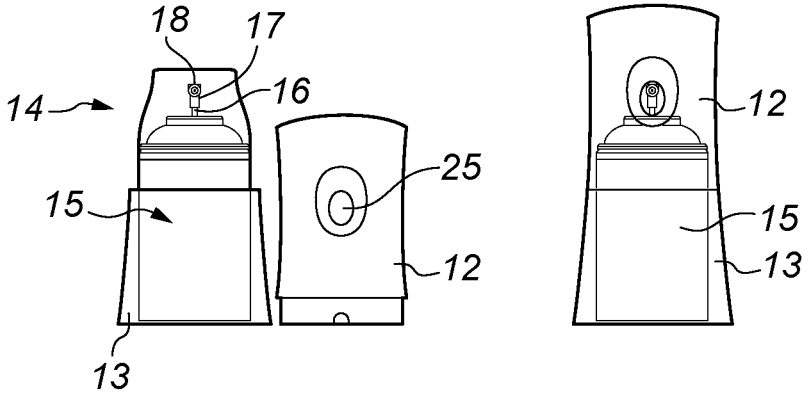
FIG. 2 illustrates a disassembled device according to the present invention.
Figure 3:
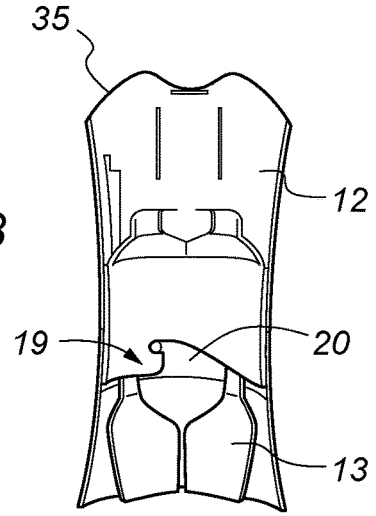
FIG. 3 illustrates a cross-sectional view of a device according to the present invention.

Turning to FIGS. 2&3 a device 10 according to the present invention is illustrated. The device 10 comprises a housing 11 which is composed of a top portion 12 and a base portion 13. A refill 14 is provided here as an aerosol canister of pressurised fluid but could be a bottle or container or a cartridge or such like holding a reservoir of fluid to be sprayed. The refill 14 comprises a refill body 15 containing the reservoir of fluid to be sprayed, a valve stem 16 in fluid communication with the reservoir and a spray head 17 mounted on the valve stem 16, the spray head having a spray exit nozzle 18. The refill 14 can be housed within the device 10 by the top portion 12 being located over the top of the refill 14 and lowered until an engagement mechanism 19, shown in FIG. 3 as a bayonet fitting 20, releasably securely connects the top portion 12 and the base portion 13. During the lowering of the top portion 12 an alignment means 21 contacts and imparts rotation movement to the spray head 17 to orientate same relative to the spray opening 25 and that will be discussed below in relation to FIGS. 4&5.

Figure 4:
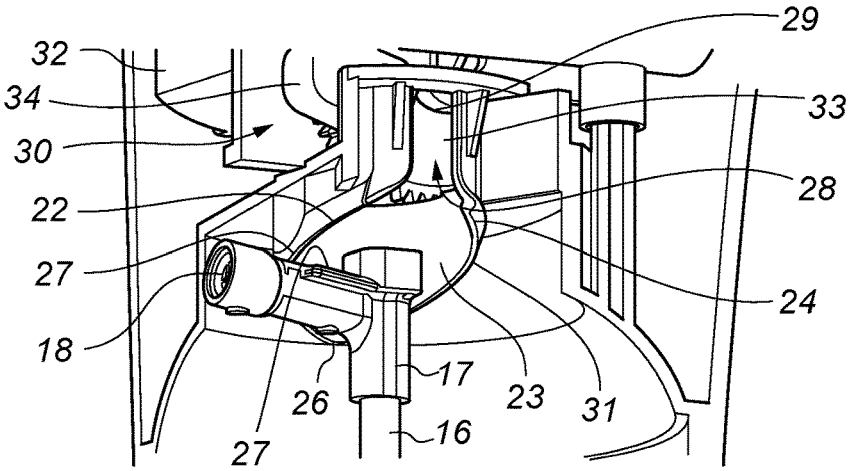
FIG. 4 illustrates a view of the interior of a device according to the present invention.
Figure 5:
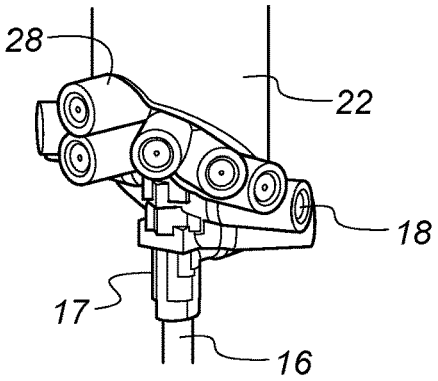
FIG. 5 illustrates a time-lapse view of rotation applied to a refill spray head by the alignment means of a spray device according to the present invention.

In FIG. 4 a sectional view of the top portion 12 is shown to better describe the features of the alignment means 21 and their inter-operation with the refill spray head 17. The alignment means 21 is provided by a radially-spaced ledge 22 substantially co-axial with the valve stem 16 of the refill 14. The ledge 22 is provided with an at least partially hollow core 23 to receive at least a portion of the refill spray head 17 therein. The ledge 22 extends downwardly from the top portion 12 toward the base portion 13 such that the ledge 22 has a section 24 adjacent the spray opening 25 that extends less than the rearmost part 26 of the ledge 22 that is remote from the spray opening 25 which extends furthermost.

The radial-spacing of the ledge 22 may be of a substantially consistent radius. The hollow core 23 permits spray heads of various shapes of spray head ease of entry thereto. The consistent radius may be advantageous as the ledge 22 can contact a localised impingement point 27 of the refill spray head 17. The impingement point 27 may be suitably shaped to best interact with the ledge, for instance it may be preferable for the impingement point 27 on the refill spray head 17 to possess a curved profile to reduce friction as the spray head 17 is rotated by contact with the ledge 22, as discussed below.

The ledge 22 may extend downwardly at a substantially constant gradient from the section 24 of the ledge adjacent the spray opening 25 to the rearmost part 26 of the ledge 22. The constant gradient may be advantageous as it may facilitate a smoother rotation of the spray head 17 about the valve stem 16 as the spray head 17 is rotated through contact at the impingement point 27 by the alignment means 21, as discussed further below.

As shown in FIG. 4, the section 24 of the ledge 22 adjacent the spray opening 25 is formed to provide a recess 28 (ie—does not extend downwardly) to capture the spray head 17 when located therein. Most preferably the recess 28 is formed to closely match the lateral proportions of the spray head 17 in order to provide a support channel 29 to receive the spray head 17 when located therein and laterally support same during actuation by an actuation mechanism 30 which preferably comprises an electrically powered motor 32 with one or more gears 33 connected to the motor 32 and an actuation arm 34 connected to at least one of the motor 32 or the gears 33 which, in use, can extend into the recess 28 or support channel 29 to contact the spray head 17 and depress same to open a valve within the refill 14 to allow fluid to flow from the reservoir into the spray head 17 and out of the spray exit nozzle 18.

The ledge 22 is preferably provided by a ridge 31 since this will afford the use of less raw materials and potentially advantageously reduce the size of the impingement point 17.

Figure 6:
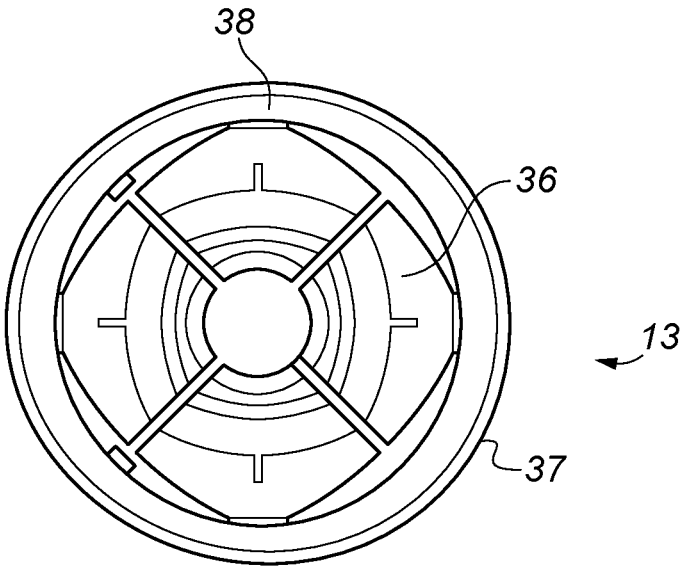
FIG. 6 illustrates a cross-sectional view of a base portion of a device according to the present invention.
Figure 7:
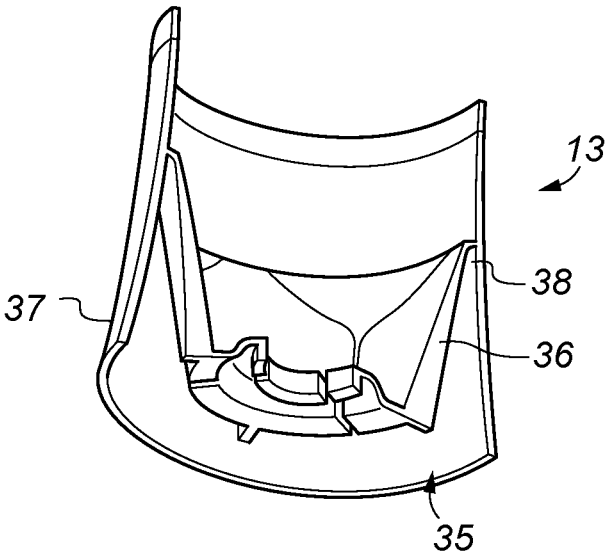
FIG. 7 illustrates an underneath view of a base portion of a device according to the present invention.

Turning to FIGS. 1, 6 &7 the base portion 13 of the housing 11 is illustrated. The base portion 13 is configured to retain at least a lower portion of the refill 14 therein. A support platform in the form of refill retaining means are provided by a plurality of refill straps 35 formed by an L-shaped member 36 wherein the longer part of the member is mounted or formed on an inner surface 37 of the cavity wall of the base portion 13 to permit flexibility and/or hinged rotation at the intersection 38 and provide an upper portion receiving channel between same and the housing wall. Each member 37 extends downwardly such that the shorter part of each member 37 projects toward a central point of the base portion 13, said shorter parts of the member 13 are configured to contact a base of the refill 14 and hold it at a predetermined location within the base portion 13. The refill straps 35 are preferably biased such that the longer part of the member 37 is biased out of contact with the inner surface 37 of the base portion 13.

The operation of the alignment means 21 on the refill spray head 17 will now be described. A user first loads the refill 14 into the base portion 13, the orientation of the spray head 17 is irrelevant. The user then locates the top portion 12 over the refill 14 and starts to move either or both of the top portion 12 and the base portion 13 toward each other with the aim of eventually causing the engagement mechanism 19 to releasably secure the top portion 12 to the base portion 13. The act of moving the top portion 12 toward the base portion 13 requires the user to move the top portion 12 downwardly relative to the base portion 13 and rotate the top portion 12 relative the base portion 13 in order for the engagement mechanism to be secured. The movement imparted by the user to the top portion 12 causes at least a portion of the spray head 17 to enter the hollow core of the alignment means 21, further downward movement causes the ridge 31 to contact the spray head 17 at the impingement point 27. Further downward movement causes the spray head 17 to rotate by virtue of following the gradient of the ridge 31 toward a lower part thereof until the spray head 17 is located in the recess 28 (or support channel 29 if present) which in turn will mean that the spray exit nozzle 18 will be directly facing the spray opening 25 and the engagement mechanism will be releasably securely engaged.

The spraying device 10 preferably defines a generally cylindrical shape wherein the top portion 12 is provided with a lid 35 that is remote from an open end, the lid 35 being accessible from the exterior of the device and may be hinged (hinge not shown). Preferably the lid provides a cover to one or more of: a battery compartment, the actuation mechanism, user input controls.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features. The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A reconfigurable spraying device adapted to be configured in a packaged configuration or an operational configuration, as well as adapted to spray a fluid from a replaceable refill comprising a refill body containing a reservoir of fluid to be sprayed, a valve stem in fluid communication with the reservoir and a spray head mounted on the valve stem, the spray head having an exit nozzle, wherein the spraying device comprises:

a housing formed from a top portion and a base portion which are releasably connectable with each other through contact between engagement means on each portion, wherein the top portion comprises:

a cavity configured to house at least an top portion of the refill therein;

a top surface and an engagement means having a top portion housing wall therebetween, wherein the top portion housing wall has a thickness;

an actuation mechanism configured, in use, to actuate the spray head to spray fluid via the exit nozzle;

a spray opening configured to permit, in use, sprayed fluid to exit the device into the surrounding environment;

and wherein the base portion comprises:

a cavity configured to house at least a base portion of the refill therein said cavity being defined by a cavity wall and a support platform configured, in use, to support the refill at a predefined position in the cavity;

the base portion being provided with an engagement means and a bottom surface and a base portion housing wall therebetween;

wherein the base portion housing wall at least adjacent the bottom surface is spaced apart from the cavity wall by at least the predefined top housing wall thickness to define a top portion receiving channel locating within an underside of the base portion and outside of the cavity and configured to receive at least some of the top portion housing wall of the top portion;

and wherein;

when the top portion and the base portion are in an operational configuration, the top portion engagement means and the base portion engagement means are engaged with each other with the refill located within the housing; and when the top portion and the base portion are in a packaged configuration, at the top portion engagement means is engaged with the underside of the base portion and at least some of the top portion housing wall of the top portion are located within the top portion receiving channel;

and wherein the packaged configuration permits the device to possess a height that is the same or less than the refill.

2. The spraying device according to claim 1, wherein the top portion receiving channel extends at least 20% of the height of the base portion wall.

3. The spraying device according to claim 1, wherein the support platform is provided by refill retaining means in the form one or more refill straps.

4. The spraying device according to claim 3, wherein said one or more refill straps are formed by an L-shaped member wherein the longer part of the member is mounted or formed on an inner surface of the cavity wall of the base portion to permit flexibility and/or hinged rotation thereabout and extends downwardly to permit the shorter part of the member to project toward a central point of the base portion and are configured to contact the base of the refill.

5. The spraying device according to claim 1, wherein the engagement means are provided as part of the engagement surface.

6. The spraying device according to claim 2, wherein the top portion receiving channel extends at least 35% of the height of the base portion.

7. The spraying device according to claim 6, wherein the top portion receiving channel extends at least 50% of the height of the base portion.

* * * * *